US010021941B2

(12) United States Patent
Neale

(10) Patent No.: US 10,021,941 B2
(45) Date of Patent: Jul. 17, 2018

(54) FASTENING SYSTEM AND METHOD

(71) Applicant: Tom Neale, Syosset, NY (US)

(72) Inventor: Tom Neale, Syosset, NY (US)

( * ) Notice: Subject to any disclaimer, the term of this patent is extended or adjusted under 35 U.S.C. 154(b) by 0 days.

(21) Appl. No.: 14/698,036

(22) Filed: Apr. 28, 2015

(65) Prior Publication Data

US 2015/0237961 A1 Aug. 27, 2015

Related U.S. Application Data

(63) Continuation of application No. 13/343,801, filed on Jan. 5, 2012, now Pat. No. 9,044,068.

(51) Int. Cl.

| | |
|---|---|
| ***A43C 7/02*** | (2006.01) |
| ***A43C 7/08*** | (2006.01) |
| ***A43C 1/00*** | (2006.01) |

(52) U.S. Cl.

CPC ..... *A43C 7/02* (2013.01); *A43C 1/00* (2013.01); *A43C 7/08* (2013.01); *Y10T 24/3703* (2015.01); *Y10T 24/3724* (2015.01); *Y10T 24/4599* (2015.01); *Y10T 24/45984* (2015.01)

(58) Field of Classification Search

CPC ..... Y10T 24/367; Y10T 24/3672; Y10T 24/3651; Y10T 24/3708; Y10T 24/3913; Y10T 24/3984; A43C 7/00

See application file for complete search history.

(56) References Cited

U.S. PATENT DOCUMENTS 948,460 A 2/1910 Partridge
2,674,771 A * 4/1954 Novick ..... A44B 1/20 24/113 R
3,074,135 A 1/1963 Brodowski
4,097,969 A * 7/1978 Nysten ..... A44B 1/44 24/103
4,631,840 A 12/1986 Gamm
4,821,899 A * 4/1989 Nycz ..... B65D 47/0895 215/235
4,969,242 A 11/1990 Carlton, Sr.
5,038,957 A * 8/1991 Gross ..... B65D 47/0861 215/235
5,333,398 A 8/1994 Seo
5,335,401 A 8/1994 Hanson
5,388,315 A 2/1995 Jones
5,467,537 A 11/1995 Aveni et al.

(Continued)

OTHER PUBLICATIONS

International Search Report dated Mar. 1, 2013 for International Application No. PCT/US2013/020330.

*Primary Examiner* — Robert Sandy
*Assistant Examiner* — Michael S Lee
(74) *Attorney, Agent, or Firm* — Tutunjian & Bitetto, P.C.

(57) ABSTRACT

A fastener assembly is provided including a fastener body having at least one aperture and a cavity formed at a top portion. A cap is provided configured to be removably inserted into the cavity. A method for fastening an article is provided including providing an article having holes in opposing edges of an article opening and a lace passed through said holes. At least one fastener body is provided having an attachment point, wherein the lace is secured to the attachment point, forming at least one slack portion. Each slack portion is pulled through a set of holes in the opposing edges of the article to form lace loop(s). Each lace loop is overlapped over the at least one fastener body.

9 Claims, 18 Drawing Sheets

(56) References Cited

U.S. PATENT DOCUMENTS

| | | | | | |
|---|---|---|---|---|---|
| 5,560,514 | A * | 10/1996 | Frazier | A47K 10/3818 | 206/210 |
| 5,572,770 | A | 12/1996 | Boden | | |
| 5,572,778 | A | 12/1996 | Stenner et al. | | |
| 5,613,283 | A | 3/1997 | Yusfan | | |
| 5,657,557 | A | 8/1997 | Hull et al. | | |
| 6,026,548 | A | 2/2000 | Jackson | | |
| 6,065,626 | A * | 5/2000 | Huang | B65D 43/0212 | 220/254.5 |
| 6,178,606 | B1 | 1/2001 | Glendon | | |
| 6,282,817 | B1 | 9/2001 | Curet | | |
| 6,338,186 | B1 | 1/2002 | Kleinmann | | |
| 6,725,575 | B2 | 4/2004 | Curet | | |
| 6,948,216 | B2 * | 9/2005 | Gaudyn | A47H 3/02 | 16/205 |
| 6,973,744 | B2 | 12/2005 | Curet | | |
| 7,596,838 | B1 | 10/2009 | Bulmer | | |
| 2005/0172463 | A1 | 8/2005 | Rolla | | |
| 2009/0229095 | A1 | 9/2009 | Valdez | | |
| 2010/0018018 | A1 | 1/2010 | Tong | | |

* cited by examiner

FIG. 8
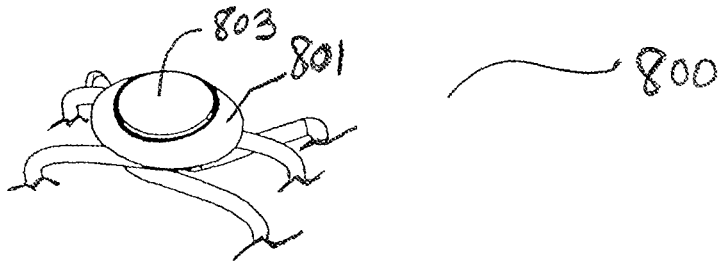
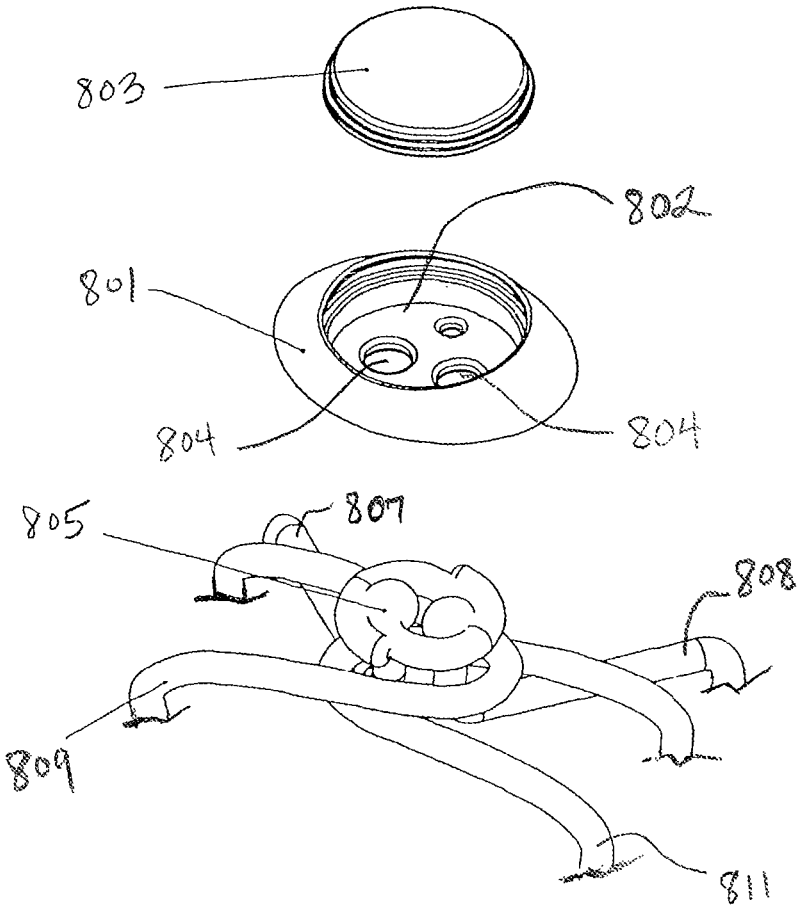
FIG. 9

SECTION A-A

FASTENING SYSTEM AND METHOD

CROSS-REFERENCE TO RELATED APPLICATION

This application is a continuation of co-pending U.S. patent application Ser. No. 13/343,801, filed Jan. 5, 2012, the disclosure of which is incorporated herein by reference in its entirety.

BACKGROUND OF THE INVENTION

1. Technical Field of the Invention

The present invention generally relates to a fastening system, and, more particularly, to a lace fastening assembly and method for using same for facilitating simple, efficient and secure fastening of an article.

2. Description of Related Art

Fastening or tightening objects by means of strings or laces is known. Typically, a string or lace is run through a series of holes on opposing sides of an article to be secured together, and the free ends of the string or lace are then pulled to bring the opposing sides together.

In particular, many types of footwear employ lacing to secure footwear onto the foot. While alternate fastening means exist, such as fabric hook and loop fasteners, zippers, etc., tying with laces is often superior for a number of reasons. For example, the use of laces provides the user with many more degrees of adjustment in the fit of an article, enabling the user to create as snug or loose a fit as desired. Namely, as the material of the footwear itself is worn over time it becomes broken in, causing a looser fit, which the user can compensate for by tying the laces tighter. In other instances, the user's foot may swell slightly during the course of the day, and the user may accordingly loosen the laces a desired amount to accommodate the swelling. A true custom fit is thus achieved each time the footwear is worn.

Another advantage with using laces as a fastening system in footwear is that it typically provides greater strength than zippers or hook and loop fasteners, both of which are prone to breakage and failure, especially during vigorous athletic activities which impose high tensile forces upon a footwear's fastening means.

However, conventional lacing systems have some disadvantages over other fastening means. For example, tying laces is typically more time consuming than using, e.g., a zipper, and also involves a degree of skill and manual dexterity to create a proper knot of sufficient tightness and end loop lengths to ensure the knot will not be too easily untied.

In the case of footwear, laces also add bulk to the top of a shoe, especially due to the knot and/or free end portions of the lace. This can be especially disadvantageous in certain sports, such as soccer, where footwear which has a low profile kicking surface is essential.

Furthermore, laces often nevertheless become untied, sometimes repeatedly, especially when the user engages in athletic activity, particularly in youth sports. In footwear, this creates a hazardous situation for the user by increasing the risk of tripping, thus requiring the user to stop, bend down and retie the lace before being able to return to the activity.

During, e.g., a team sport activity, this can be disruptive not only to the user but to the players, coaches and spectators, particularly in youth sports where children require adults to tie their laces. Repeated instances of laces becoming untied by multiple players can seriously interrupt the overall flow of a game.

While extra knots could be employed to prevent a lace from become untied during use, this is often undesirable as it increases the difficulty and time in both securing and releasing the article, as well as adds additional bulk, e.g., to the top of a shoe.

Accordingly, a need exists for an easy-to-use fastening system which securely fastens an article while adding minimal bulk, and which is easy to fasten and unfasten by the user.

SUMMARY OF THE INVENTION

The present invention generally relates to fastening systems, and more particularly, to a fastening assembly which provides secure lace fastening, quick unfastening and is easy to use. A fastening system according to the present invention may be utilized for any article in which releasable tightening and fastening via laces is desired. Non-limiting examples include various articles of clothing such as pants, tops and undergarments; bags and other accessories, therapeutic garments and footwear.

In particular, a fastening assembly according to the present invention is advantageously used for securely fastening footwear to a user's foot while adding minimal bulk to the footwear, especially to the top surface of the footwear, and is easy to fasten and unfasten by the user. For illustrative purposes only, and not by way of limitation, a fastening device and method will be shown herein with respect to footwear.

The present invention enhances safety and functionality by providing a simplified fastening system that is easily used even by those with physical limitations and which eliminates the possibility of untied laces. Advantageously, the customized adjustment and support provided by laces is preserved while ease of use is improved.

According to one aspect of the present invention, a fastening assembly is provided comprising a fastener body having at least one aperture for receiving free ends of a lace, and a cavity formed in a top portion thereof. A removable cap is provided configured to be received within the cavity.

According to another aspect of the present invention, a fastener assembly is provided comprising a fastener body having at least one aperture and a cavity formed at a top portion. A cap is provided configured to be removably inserted into the cavity.

According to another aspect, a fastener assembly is provided comprising a housing defining a hole, said housing including at least two arms attached to an inner surface of the housing and which protrude into the hole, each of the arms including at least one aperture, wherein the arms substantially separate the hole into an upper cavity and a lower cavity. A cap is provided configured for removable insertion into the upper cavity.

According to yet another aspect, a method for fastening an article is provided comprising the steps of providing an article having holes in opposing edges of an article opening and a lace passed through said holes, said lace having a first end and a second end, wherein the lace further comprises at least one free end portion. A fastener body is provided having at least one aperture, wherein the at least one free end portion is inserted into the at least one aperture and secured to the fastener body, forming at least one slack portion. Each slack portion is pulled through a set of holes in the opposing edges of the article to form at least one lace loop. Each lace loop is overlapped over the fastener body.

According to yet another aspect, a method for fastening an article is provided including the steps of providing an article having holes in opposing edges of an article opening and a lace passed through said holes. At least one fastener body is provided having an attachment point, wherein the lace is secured to the attachment point, forming at least one slack portion. Each slack portion is pulled through a set of holes in the opposing edges of the article to form lace loop(s). Each lace loop is overlapped over the at least one fastener body.

These and other aspects, features, and advantages of the present invention will be described or become apparent from the following detailed description of the preferred embodiments, which is to be read in connection with the accompanying drawings.

BRIEF DESCRIPTION OF THE DRAWINGS

In the drawings, wherein like reference numerals denote similar elements throughout the views:

FIG. 8 is a fragmented front perspective view of an exemplary fastener assembly in a fastened configuration according to another embodiment of the present invention, with only portions of laces shown for ease of illustration;

FIG. 9 is an exploded view of the exemplary fastener assembly of FIG. 8;

Figure 1:
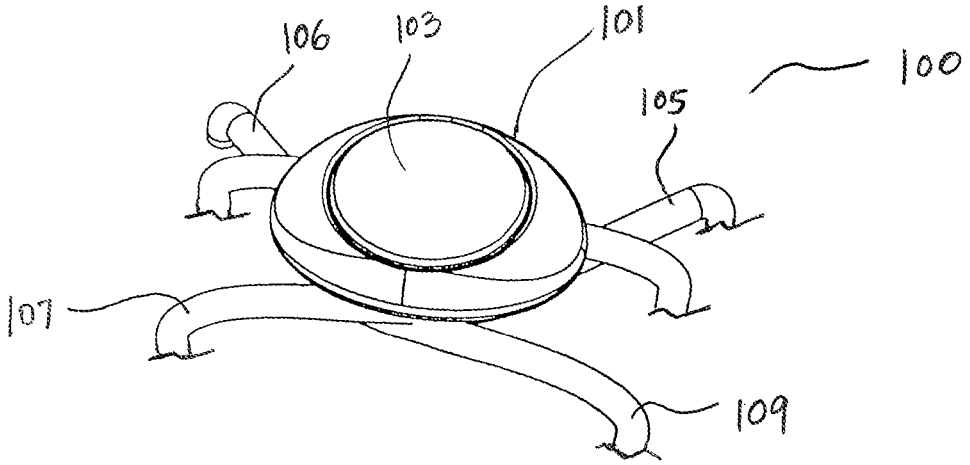
FIG. 1 is an fragmented front perspective view of an exemplary fastener assembly in a fastened configuration according to an aspect of the present invention, with only portions of laces shown for ease of illustration.
Figure 2:
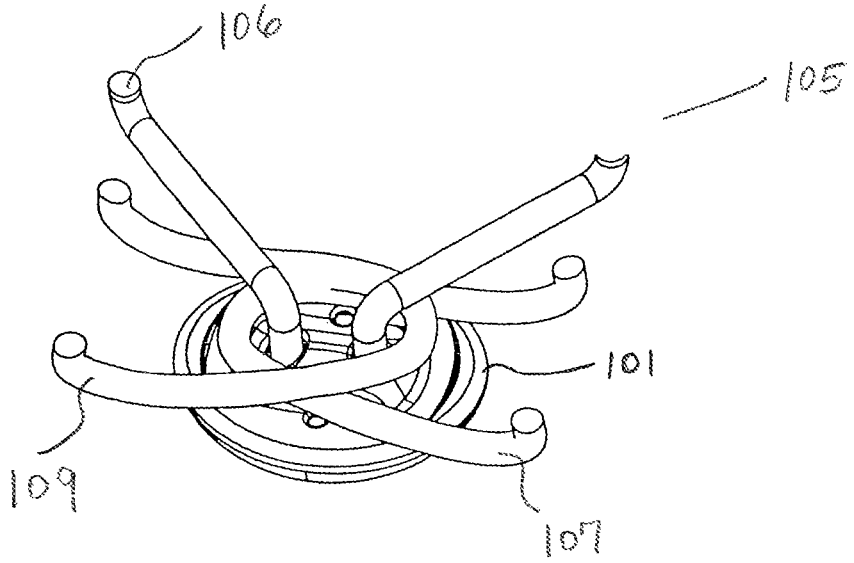
FIG. 2 is a bottom perspective view of the exemplary fastener assembly of FIG. 1.

It should be understood that the drawings are for purposes of illustrating the concepts of the invention and are not necessarily the only possible configurations for illustrating the invention.

DETAILED DESCRIPTION OF PREFERRED EMBODIMENTS

A fastener assembly in accordance with an aspect of the present invention, advantageously enables an article (which may include holes/eyelets) that employs laces to be fastened or tightened securely in an efficient manner, while minimizing added bulk to the article and providing inimitable ease of use for the user. Especially when used with respect to, e.g., apparel or footwear, a fastener assembly according to an aspect of the present invention promotes safety and comfort for the user by preventing untied laces and avoiding added bulk next to the body, while enhancing aesthetic appeal and providing a neat, streamlined appearance.

An exemplary fastener assembly 100 according to one embodiment of the present invention is illustrated in and will now be described with respect to the various views of FIG. 1 to FIG. 7B. According to one embodiment, the fastener assembly 100 comprises a fastener body 101 which preferably includes at least two apertures 303 through which are inserted a plurality of lace ends 105, 106.

A top portion of the body 101 preferably includes a cavity 301 into which a cap 103 may be received.

The fastener body according to the invention may be in the shape of a disc (as shown in the drawings for exemplary purposes, but not by way of limitation), but may be formed in any shape, e.g., the body 101 may be cylindrical, conical, spherical, or any other two or three-dimensional form and/or irregular, symmetrical and/or asymmetrical shape including dog bones, star shapes, prisms, etc. Preferably, the shape of the body 101 is flattened laterally, so as to provide an overall streamlined appearance, low profile and reduce bulk.

The fastener body and cap of the present invention may be comprised in whole or in part of any substantially rigid material, including but not limited to plastic, polymers, resins, metal and metal alloys, glass, bone, shells, wood, and the like and any combination or composite thereof, and further, may include coatings or coverings comprised of, e.g., lacquered/adhesive finishes and coverings, silicon, rubber and the like. The fastener body and cap of the present invention are preferably shaped and sized to be easily manipulated by hand, but may be provided in a range of sizes and shapes without departing from the scope or spirit of the present invention.

The laces used in the present invention may comprise any suitable material for cordage including but not limited to cotton, nylon and other synthetic fibers or natural/synthetic blends, and further, may preferably be elastic by, e.g., incorporating elastic fibers therein to impart elastic/resilient properties at least along a portion of the length of the lace and/or the entire lace in a longitudinal/lateral direction.

Figure 3:
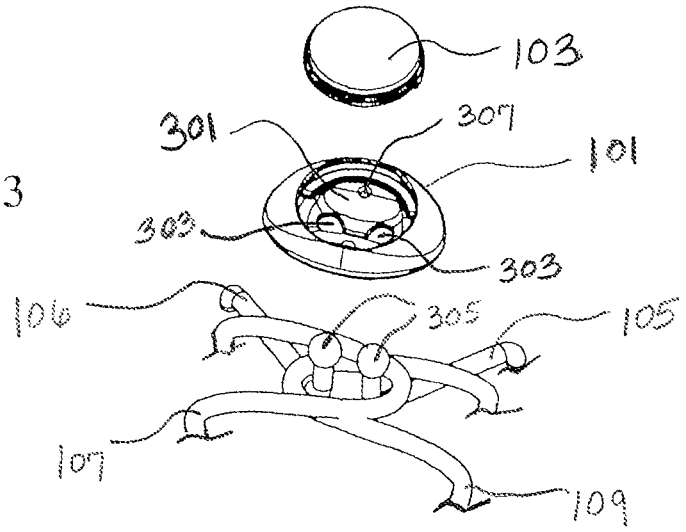
FIG. 3 is an exploded view of the exemplary fastener assembly of FIG. 1.

As shown in FIG. 3, each end of lace 105, 106 may be inserted through the apertures 303 formed in the bottom of the body 101 to enter into the cavity 301. The lace ends 105, 106 may be secured to the body 101 via, e.g., enlarged ends 305, which preferably sit within the cavity 301 to prevent the laces 105, 106 from being removed once inserted into the apertures 303. The term 'enlarged ends' used herein may comprise, e.g., knots, bumps, end caps, cord locks or other protrusions formed/placed at the lace ends to prevent the lace ends from sliding through the apertures.

The cavity 301 may be of any shape and is preferably at least of a size and depth sufficient to contain the enlarged ends 305. In one exemplary embodiment, the cavity 301 may include a rim 701 and the cap 103 may include correspondingly shaped ridges/edges 703 to mate with the rim 701 and thus improve secure fitting of the cap 103 within the body 101.

The cap 103 is preferably formed of a size, depth and shape corresponding to the cavity 301 so as to be configured to be removably inserted within and seal the cavity. When fitted within the cavity 301, the cap 103 is preferably flush and/or follows a similarly contoured shape with a top surface of the body 101.

Figure 4:
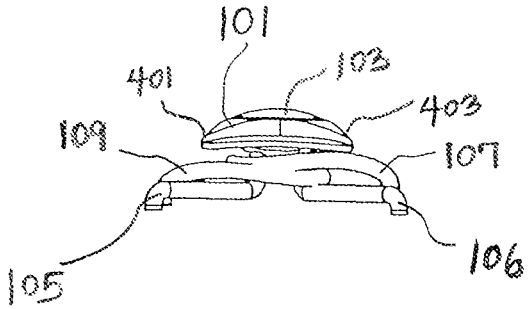
FIG. 4 is a side elevation view of the exemplary fastener assembly of FIG. 1.
Figure 5:
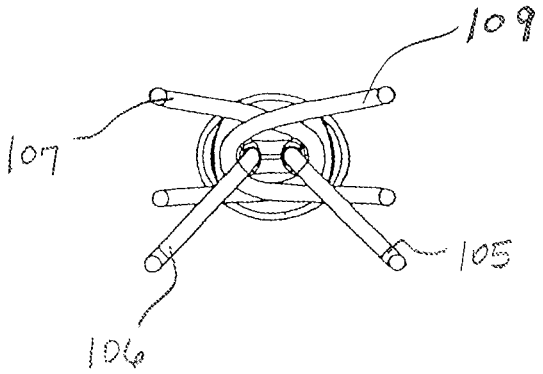
FIG. 5 is a bottom view of the exemplary fastener assembly of FIG. 1.
Figure 6:
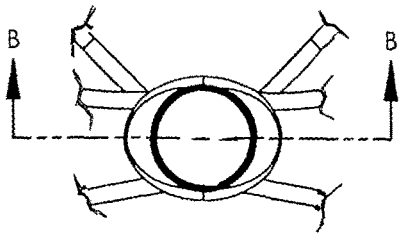
FIG. 6 is a top view of the exemplary fastener assembly of FIG. 1.
Figure 7A:
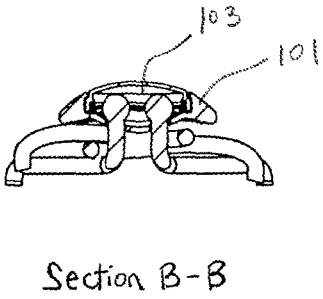
FIG. 7A is a cross-sectional view of the exemplary fastener assembly of FIG. 1 taken along sectional line B-B in FIG. 6.
Figure 7B:
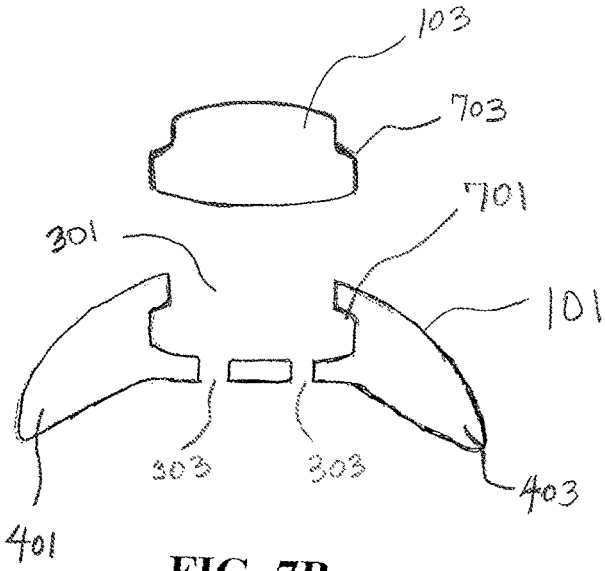
FIG. 7B is an enlarged cross-sectional view of the exemplary fastener body of FIG. 1 taken along sectional line B-B in FIG. 6.
Figure 10:
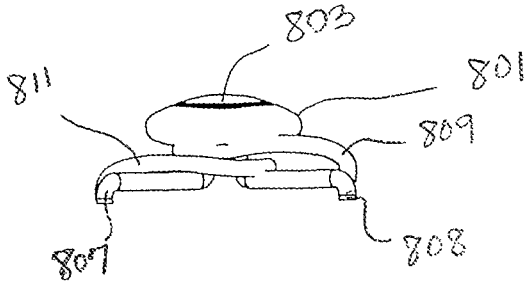
FIG. 10 is a side elevation view of the exemplary fastener assembly of FIG. 8.
Figure 11A:
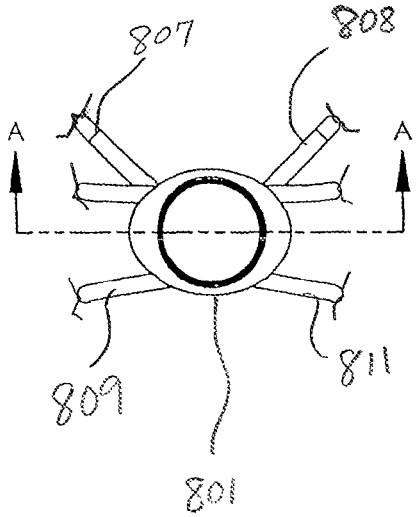
FIG. 11A is a top view of the exemplary fastener assembly of FIG. 8.
Figure 11B:
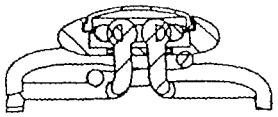
FIG. 11B is a cross-sectional view of the exemplary fastener assembly of FIG. 8 taken along sectional line A-A in FIG. 11A.
Figure 12:
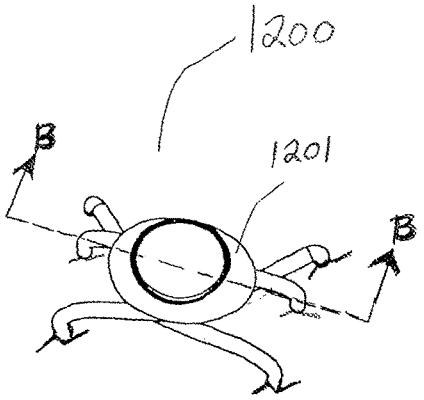
FIG. 12 is an fragmented front perspective view of an exemplary fastener assembly in a fastened configuration according to another embodiment of the present invention, with only portions of laces shown for ease of illustration.
Figure 13:
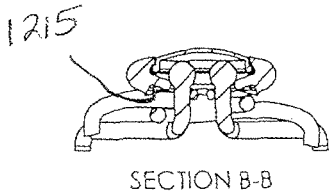
FIG. 13 is a cross-sectional view of the exemplary fastener assembly of FIG. 12 taken along sectional line B-B in FIG. 12.
Figure 14:
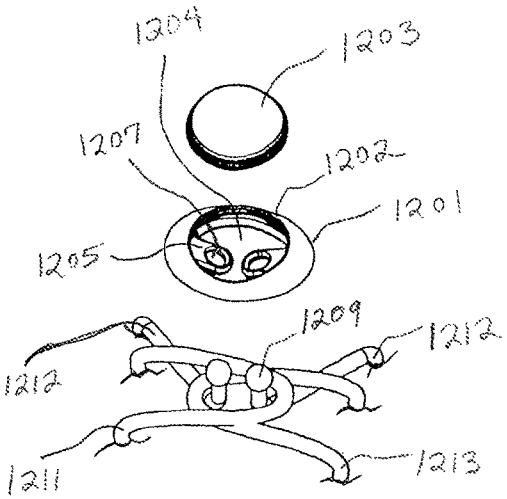
FIG. 14 is an exploded view of the exemplary fastener assembly of FIG. 12.

According to the embodiment shown in FIGS. 1-7B, the fastener body 101 is preferably curved so as to have at least a substantially convex top surface (which is further complemented with a cap 103 having a substantially convex top surface inserted therein), and/or a substantially concave bottom surface, e.g., as shown in FIGS. 4, 7A and 7B. That is, the cap 103 may be configured to have a convex top surface to conform to the curved topline of the fastener body 101.

For example, the fastener body 101 includes curved ends 401, 403 and a concave bottom surface (shown e.g., in FIG. 7B) which are especially adapted for conforming to a curved surface. The curved ends 401, 403 preferably curve downwards in a direction away from the top portion of the fastening body 101.

This is particularly advantageous in a footwear application, in that the fastener assembly 100 is advantageously configured to conform to the top surface of a shoe to closely follow and 'hug' the surface of the user's instep, and provide an overall lower profile and minimize bulk on the shoe. Furthermore, the curved ends 401, 403 of the fastener body 101 improve secure fastening and holding of lace loops 107, 109 thereon, as described further below.

According to one exemplary aspect, a fastener body according to the present invention preferably includes an attachment point which may comprise at least two apertures, with each aperture proximate to each opposing end of the fastener body. For example, when the fastener body is substantially disc-shaped as shown, the apertures are preferably located opposite from each other, on opposite ends of the disc.

However, it may be contemplated that the fastener body as described herein may include as an attachment point only a single aperture or any number of apertures arranged in any configuration. Furthermore, in lieu of or in addition to apertures formed within the fastener body, the attachment point of the fastener body may comprise any means for attachment of a lace, such as external attachment points including protrusions formed on or attached to the fastener body which themselves may include an aperture, and the like.

Figure 19A:
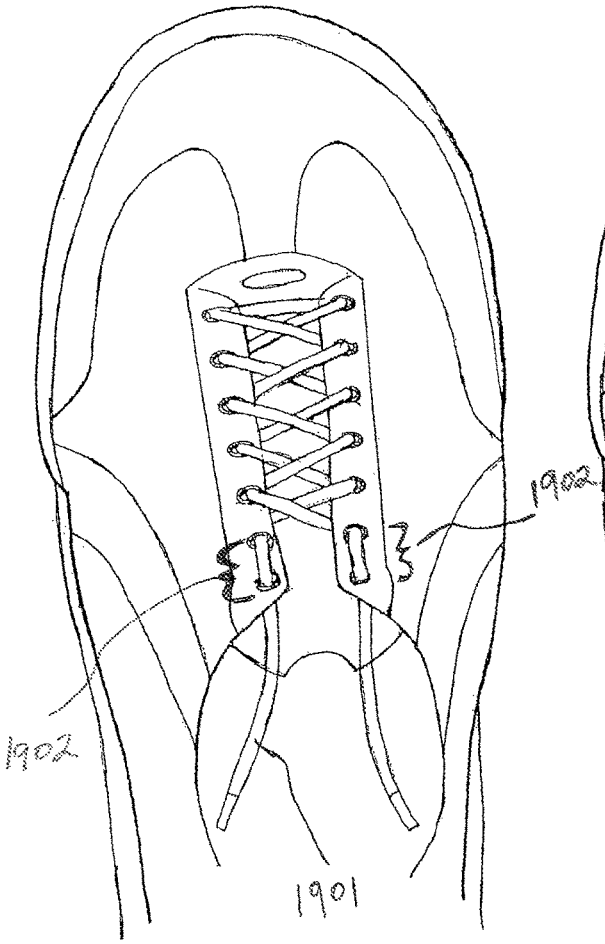
FIGS. 19A-19E are exemplary illustrations for depicting sequentially, fastening a shoelace using a fastener assembly according to the present invention.
Figure 19B:
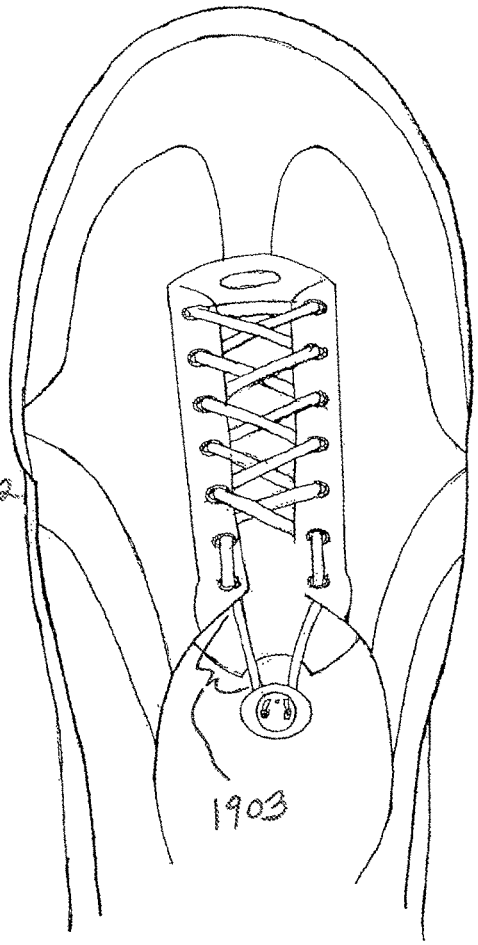
Figure 20A:
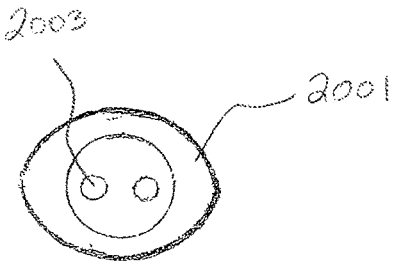
FIG. 20A is a top view of an exemplary fastening device for insertion into the laces shown in FIG. 19A.
Figure 20B:
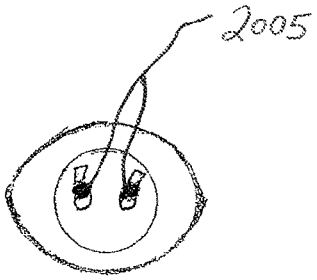
FIG. 20B is an enlarged top view of the exemplary fastening device in FIG. 19B showing the lace ends inserted there through and secured.
Figure 19C:
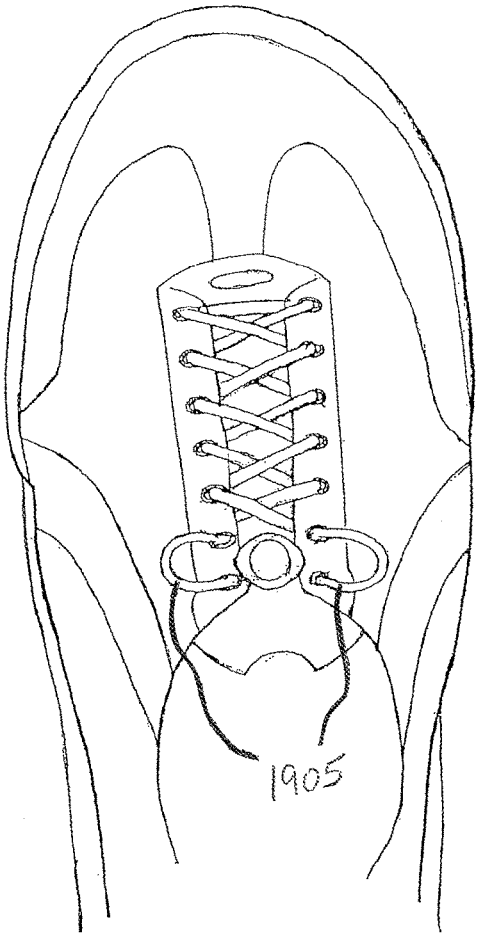
Figure 19D:
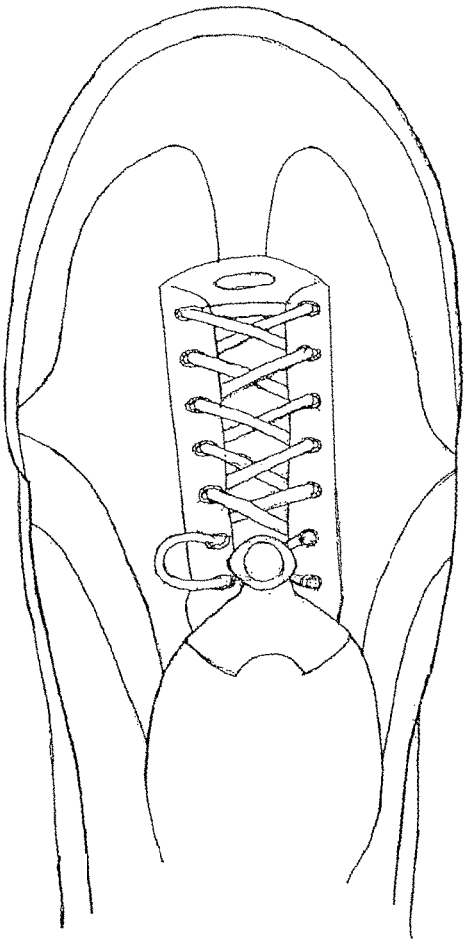
Figure 19E:
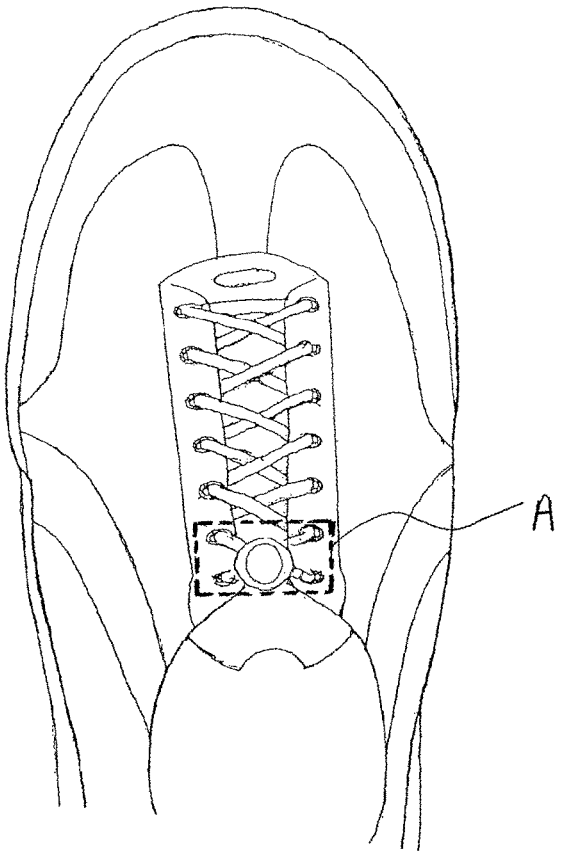
Figure 20C:
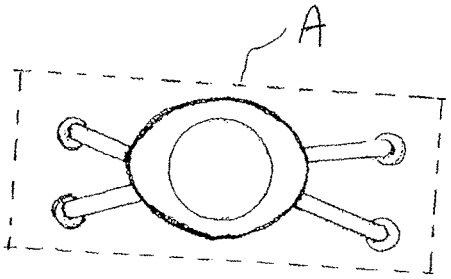
FIG. 20C is an enlarged top view of portion "A" in FIG. 19E, showing the exemplary fastening device in a fastened position.
Figure 20D:
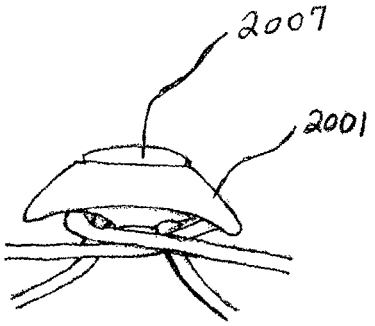
FIG. 20D is a side view of the exemplary fastening device shown in FIG. 20C.
Figure 19F:
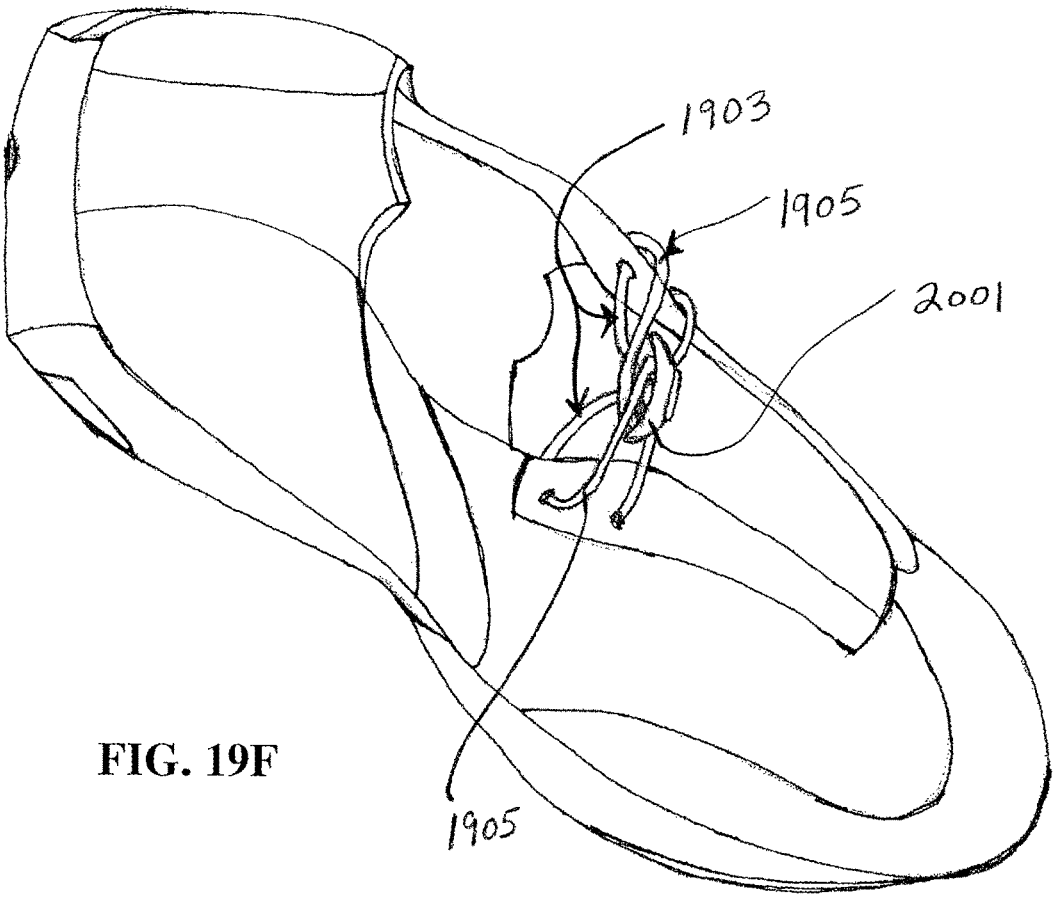
FIG. 19F is a perspective view showing an exemplary fastener assembly in a fastened configuration.
Figure 20E:
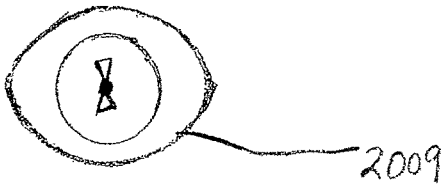
FIG. 20E is an enlarged top view of an exemplary fastening device according to an alternate embodiment.
Figure 19G:
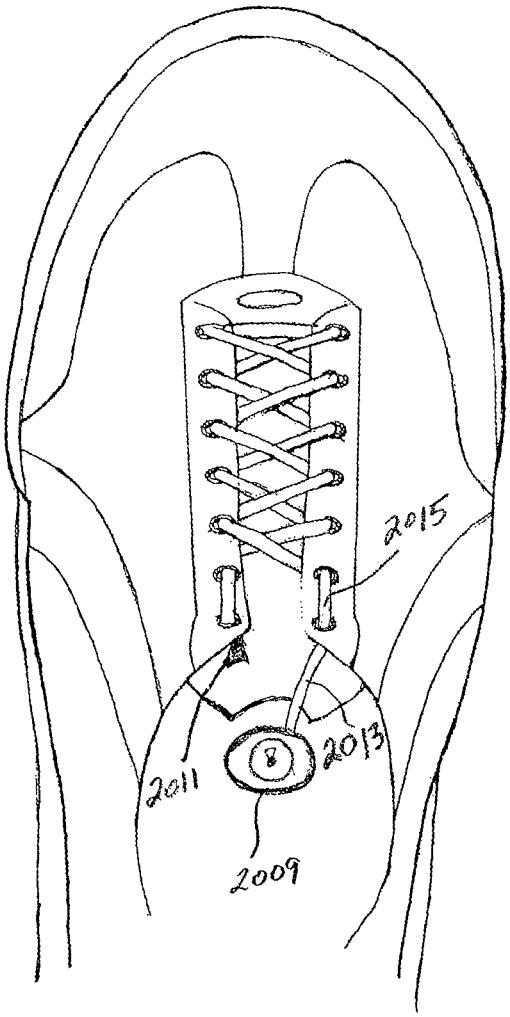
FIG. 19G is an exemplary illustration showing a shoelace being fastened using a fastener assembly according to an alternate embodiment.

For example, the fastener body may comprise a single aperture through which at least one free lace end is inserted and secured (e.g., as shown in FIGS. 19G and 20E). Alternately, the single aperture may be of a sufficient diameter that two or more free lace ends may be inserted and secured therein. In another embodiment, the fastener body may include an external attachment point such as a protrusion which includes an aperture, through which e.g., a lace is run through.

A lace may be secured to the fastener body via knots, enlarged ends, end caps, or simply being run through the fastener body or through an external attachment point on the fastener body.

Furthermore, an additional aperture(s) 307 in the fastener body may be provided which preferably communicates with the cavity to facilitate, e.g., easier removal of the cap by inserting a tool through the additional aperture(s) 307 upwards into the cavity, thus pushing out the cap.

The fastened configuration of the assembly 100 as shown in FIGS. 1-7A is by way of example only, and will be described herein as well as with reference to FIGS. 19A-19E. In this exemplary embodiment, a length of lace having two free ends is provided, with a substantial portion of its length preferably laced through opposing sides of an article opening desired to be fastened. Once each lace end 105, 106 is secured to the fastener body 101, the entire length of the lace essentially forms a continuous loop.

When it is desired for the fastener assembly 100 to fasten (close/tighten) the article opening, each lace end 105, 106 is pulled (preferably through eyelets of the article desired to be fastened) so that a certain amount of slack in the lace is created, thus forming an adjacent portion of each lace end into an independent loop (e.g., loops 107 and 109). Each independent loop 107 and 109 is then pulled over the body 101 preferably in succession so as to overlap one another, thus taking up and effectively securing the slack in the lace.

An exemplary fastener assembly 800 according to another embodiment of the present invention is shown in FIG. 8 to FIG. 11B. This alternate embodiment differs from the embodiment shown in FIGS. 1-7B in that the fastener body 801 comprises a substantially straight side profile (i.e., without downwards curving ends) as shown, e.g., in FIGS. 10 and 11B. However, laces 807, 808 and loops 809 and 811 may be fastened in a similar fashion as described with reference to FIGS. 1-7B above.

A cap 803 may be provided which is shaped to be removably insertable into a cavity 802 of the fastener body 801. Lace ends 807, 808 are inserted into apertures 804 and secured to the fastener body 801 via e.g., enlarged ends 805. Lace loops 809, 811 are overlapped over the fastener body 801 to achieve the fastened configuration shown.

An exemplary fastener assembly 1200 according to another embodiment of the present invention is shown in FIGS. 12-15C. According to this alternate embodiment, a fastener body 1201 may comprise a housing 1202 defining a hollow/interior hole 1204. The housing 1202 may comprise e.g., but is not limited to, a ring or oval shape. Preferably, the housing 1202 includes at least two arms 1205 which are attached to an inner surface of the housing 1202 and which protrude into the interior hole 1204.

In one exemplary aspect, the arms 1205 are attached, for example, substantially in a center of the inner surface of the housing 1202 and are preferably angled downwards (i.e., away from an attached cap 1203) with respect to the housing 1202, so as to protrude into the hole 1204 at a non-perpendicular angle.

Each of the arms 1205 further preferably includes at least one aperture 1207.

Figure 15A:
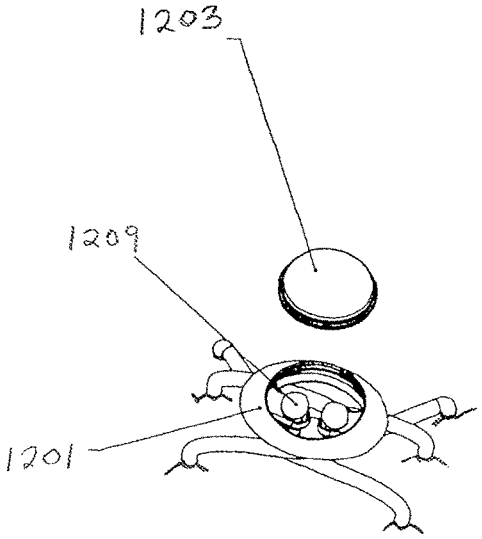
FIG. 15A is a partially exploded view of the exemplary fastener assembly of FIG. 12.
Figure 15B:
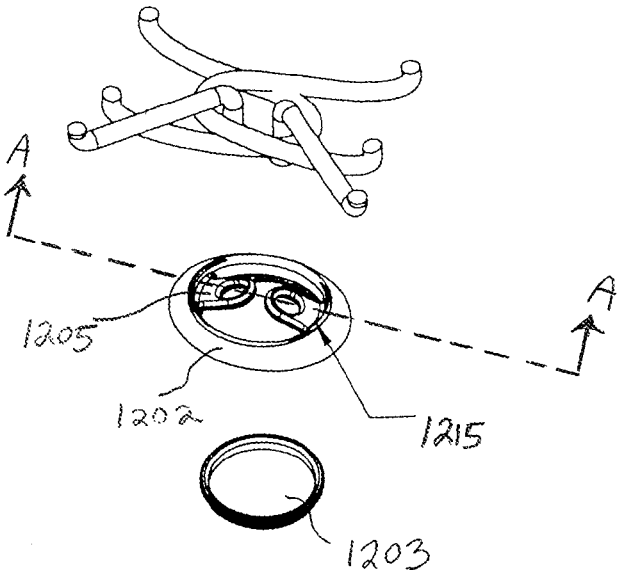
FIG. 15B is an upside down exploded view of the exemplary fastener assembly of FIG. 12.
Figure 15C:
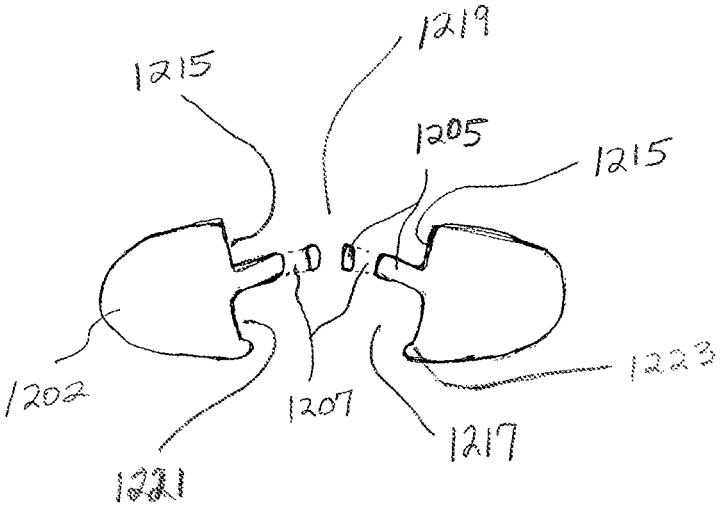
FIG. 15C is an enlarged upside-down side view of the housing of FIG. 15B taken along line A-A.

The arms 1205 substantially separate the hole 1204 into an upper cavity 1217 and a lower cavity 1219. The upper cavity 1217 is further defined by the upper portion of the housing 1202 and is preferably configured for removable insertion of a cap 1203 therein. The upper portion of the housing 1202 may include various features for securing the cap 1203 once it is inserted, including, but not limited to, tapered walls, clips, protrusions and ridges. For example, protrusions 1223 are shown in FIG. 15C.

Lace ends 1212 are inserted into apertures 1207 and secured to the fastener body 1201 via e.g., knots 1209. Lace loops 1211, 1213 are overlapped over the fastener body 1201 to achieve the fastened configuration shown.

According to an advantageous aspect of this embodiment, a bottom of the housing 1202 includes at least one, preferably two ridges 1215 within the lower cavity 1219. The ridges 1215 are formed and defined with respect to the angulation of the arms 1205 as described above, and facilitate grabbing and securing of the lace loops 1211, 1213 when the lace loops are in a fastened configuration.

Advantageously, the angulation of the arms 1205 in the downwards direction causes the arms to protrude into the lower cavity 1219 and causes the angle between the ridges 1215 and the arms 1205 to be smaller relative to the angle between the arms 1205 and the side walls 1221 of the upper cavity 1217. This downwards angulation of the arms 1205 improves the secure fastening of the lace loops and prevents their slippage once secured.

It is to be noted that the fastener assembly 1200 of this embodiment may alternately be comprised of a fastener body having curved ends (e.g., as shown in FIGS. 1-7B) and/or a convex top surface.

Figure 16:
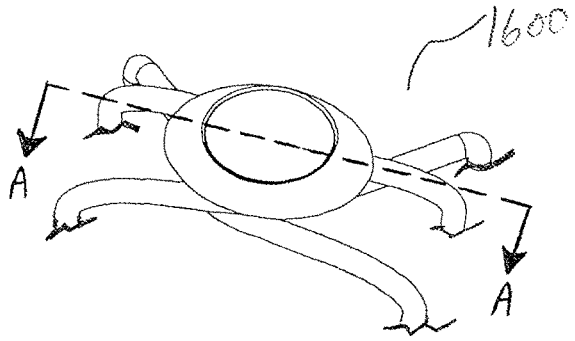
FIG. 16 is an fragmented front perspective view of an exemplary fastener assembly in a fastened configuration according to another embodiment of the present invention, with only portions of laces shown for ease of illustration.
Figure 17:
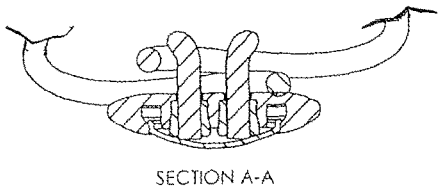
FIG. 17 is a cross-sectional view of the exemplary fastener assembly of FIG. 16 taken along sectional line A-A in FIG. 16.
Figure 18:
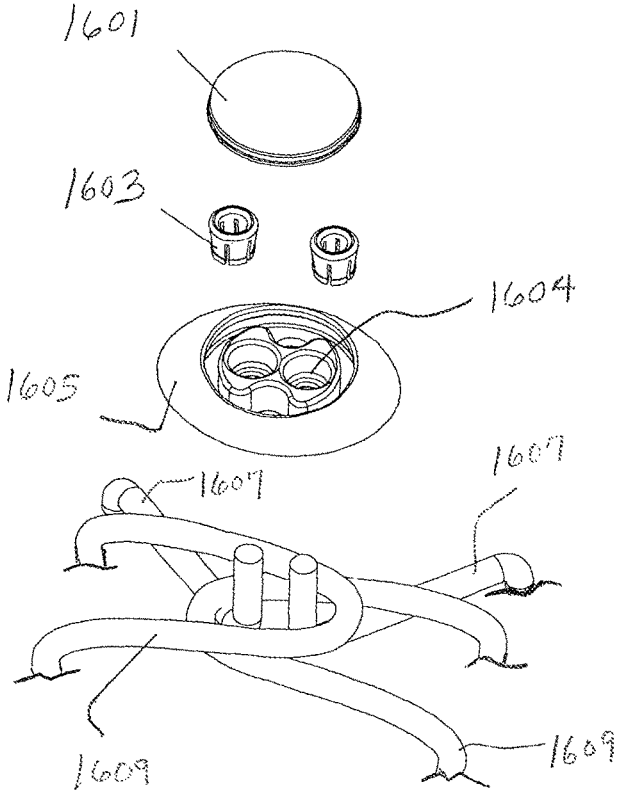
FIG. 18 is an exploded view of the exemplary fastener assembly of FIG. 16.

An exemplary fastener assembly 1600 according to another embodiment of the present invention is shown in FIGS. 16-18. According to this alternate embodiment, lace ends 1607 are secured within the fastener body 1605 via locking devices 1603. The locking devices 1603 may comprise, e.g., a pair of hollow rings configured to nest and achieve a compressive pressure fit within apertures 1604, and are preferably of a diameter which is less than a diameter of the lace being used. The locking devices 1603 may include additional lace securing means, such as teeth, ridges and slots, which are configured, e.g., to press/insert into and thus further secure the fibers of the lace.

Lace ends 1607 are inserted through apertures 1604 and through cord locks 1603. The cord locks 1603 are inserted within the apertures 1604, which further compresses and clamps the lace ends, thus firmly securing the lace end within the fastener body 1605. A cap 1601 may be provided for insertion into the top of the fastener body 1605, and lace loops 1609 are overlapped over the fastener body 1605 to achieve the fastened configuration shown.

FIGS. 19A-19E are exemplary illustrations for depicting sequentially, the fastening of a shoelace using a fastening assembly according to the present invention. FIGS. 20A-20D depict close-up views of an exemplary fastener and fastening configuration described in FIGS. 19A-19E. While the article shown in the Figures depict footwear, this is for illustrative purposes only, and not by way of limitation. It is noted that the article may comprise any type of object or article.

Figure 21:
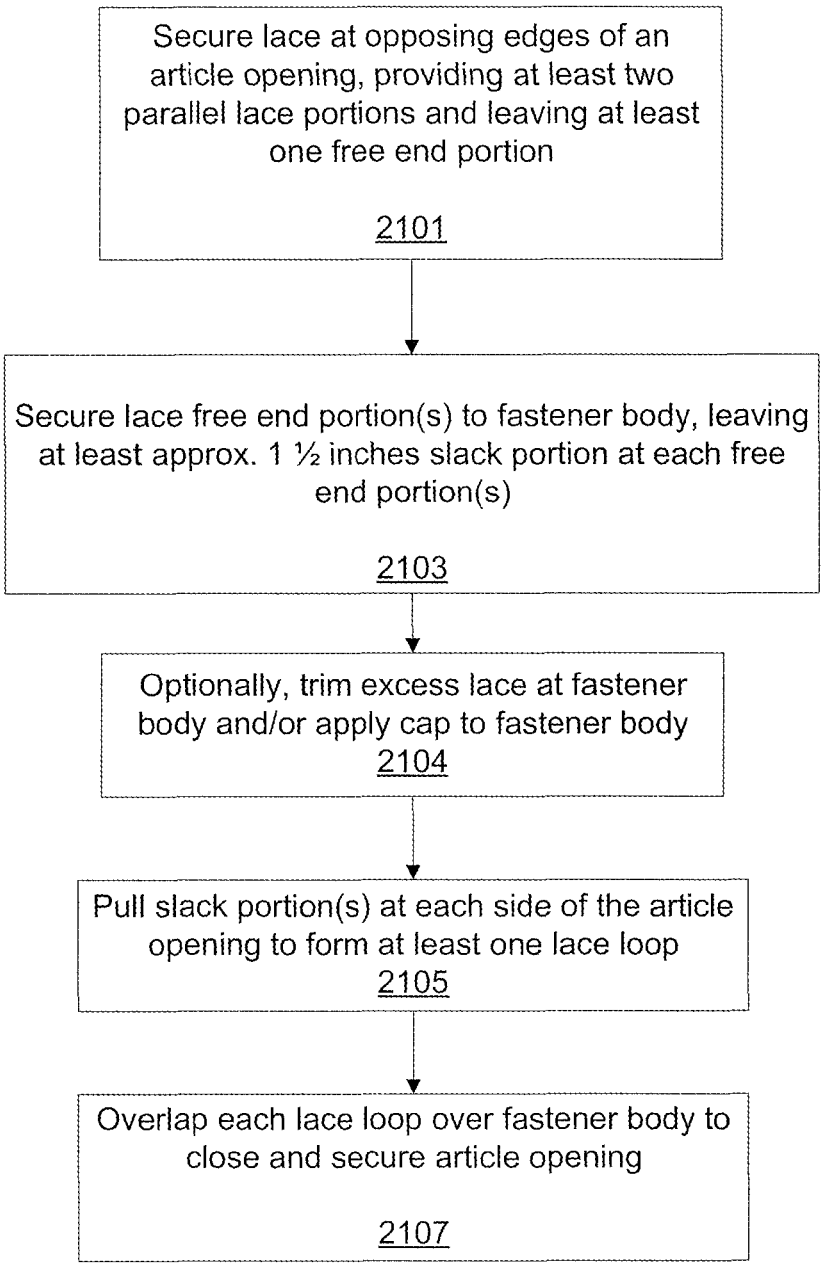
FIG. 21 is a flow diagram depicting an exemplary method for fastening according to an aspect of the present invention.

FIG. 21 is a flow diagram depicting an exemplary method for fastening according to an aspect of the present invention. The method steps of FIG. 21 will now be described with reference to FIGS. 19A-19G and FIGS. 20A-20E.

In step 2101, a lace having a first end and a second end is secured to opposing edges of an article opening which is desired to be closed/fastened. For example, the lace may be passed through holes/openings provided along/adjacent to the opposing edges of the article.

Alternate means and methods for securing the lace to the article may be contemplated. For example, the lace may be at least partially permanently secured to the article. Preferably, the lace is slidably secured to the edges of the article opening, such that it can be pulled freely through the openings to facilitate the actions of tightening and loosening the lace, thus expanding and contracting the size of the article opening.

In a preferred embodiment, the lace is secured to the article in an interwoven manner, weaving back and forth between the holes on either side of the article opening. Preferably however, the lace is run laterally through at least two pairs of holes/openings adjacent to the free ends 1901, so that each portion 1902 of the lace is caused to run substantially parallel to each other (i.e., provides at least two parallel lace portions), as shown in FIGS. 19A and 19B.

In the exemplary depiction shown in FIGS. 19A-19E, the article opening may comprise, e.g., a top portion of a shoe. Alternate types of article openings may be contemplated. The lace is preferably of a sufficient length such that once it is secured at (e.g., passed through all the holes/openings of) the article opening, at least one free end portion is provided. E.g., in the exemplary embodiment shown in FIGS. 19A-19F, a portion of each of the first and the second ends 1901 is left 'free.' Preferably, the free end portions 1901 are of a sufficient length to work with, e.g., are preferably at least about 2 inches in length, most preferably about 3 to about 4 inches in length.

In step 2103, each lace end 1901 is secured to the fastener body 2001 (e.g., by inserting into at least one aperture 2003 of a fastener body 2001). Each lace end may be secured to the fastener body 2001 via enlarged ends, e.g., knots 2005, protrusions and/or enlargements, end caps, cord locks and the like formed/placed at the lace ends.

In optional step 2104, the lace ends, once secured, are preferably trimmed to reduce excess bulk, and/or a cap 2007 may optionally be inserted into the fastener body.

Preferably, each lace end 1901 is secured to the fastener body 2001 so that at least one slack portion 1903 preferably of at least about 1½ inches, and most preferably, about 2-3 inches in length remains. It is noted that according to one exemplary embodiment in which there are two lace ends, once the lace ends are secured to the fastener body 2001, the lace itself essentially forms a continuous loop (e.g., as shown in FIG. 19B).

In step 2105, each slack portion 1903 is taken up by pulling the lace in the article, for example, at portion 1902 (e.g., a location proximate to a pair of holes/eyelets at each side of the article opening, where the lace ends are run substantially parallel to each other) thus forming at least one lace loop 1905. Each lace loop 1905 is pulled over the fastener body 2001 in an overlapping fashion (step 2107) to form the fastened configuration shown in FIG. 19E. Enlarged top and side views, respectively, of the fastened configuration of Box A in FIG. 19E are shown in FIGS. 20C and 20D. FIG. 19F shows a perspective view of the fastening assembly in a fastened configuration on a shoe.

FIG. 20E depicts an exemplary fastener 2009 comprising a single aperture. FIG. 19G depicts an exemplary alternate embodiment in which a lace is secured to an article at a first end 2011, while a second end 2013 comprises a single free end lace portion. The single free end 2013 is inserted and secured to, e.g., the fastener with a single aperture 2009. At least a lace portion 2015 (e.g., adjacent to the single free end 2013) may be pulled up to form a loop and placed over the fastener 2009 to provide a fastened assembly. Additional portions of the lace may be pulled up and over the fastener body 2009 to provide additional security.

Figure 22:
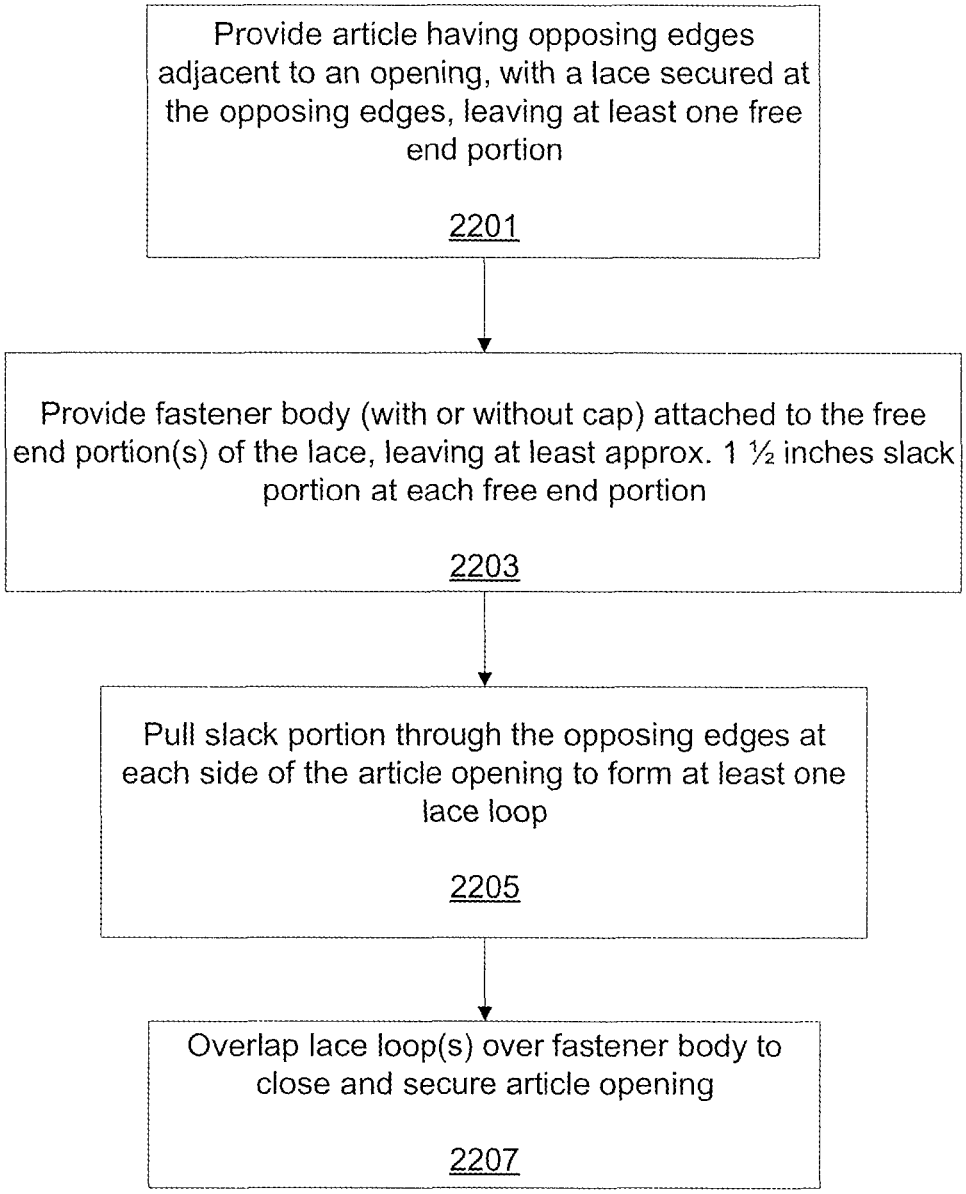
FIG. 22 depicts an exemplary method flow for fastening an article according to another aspect of the present invention.

FIG. 22 depicts an exemplary method flow for fastening an article according to another aspect of the present invention. In this exemplary depiction, an article is provided already laced (step 2201) and having at least one end portion of the lace secured to a fastener body (with or without a cap attached) (step 2203) according to the present invention. At least approximately 1½ inches of a slack portion in the lace is preferably provided.

In step 2205, each slack portion 1903 is taken up by pulling the lace through a pair of holes at each side of the article opening, thus forming at least one lace loop 1905. Each lace loop 1905 is pulled over the fastener body 2001 in an overlapping fashion to form the fastened configuration (step 2207).

Figure 19H:
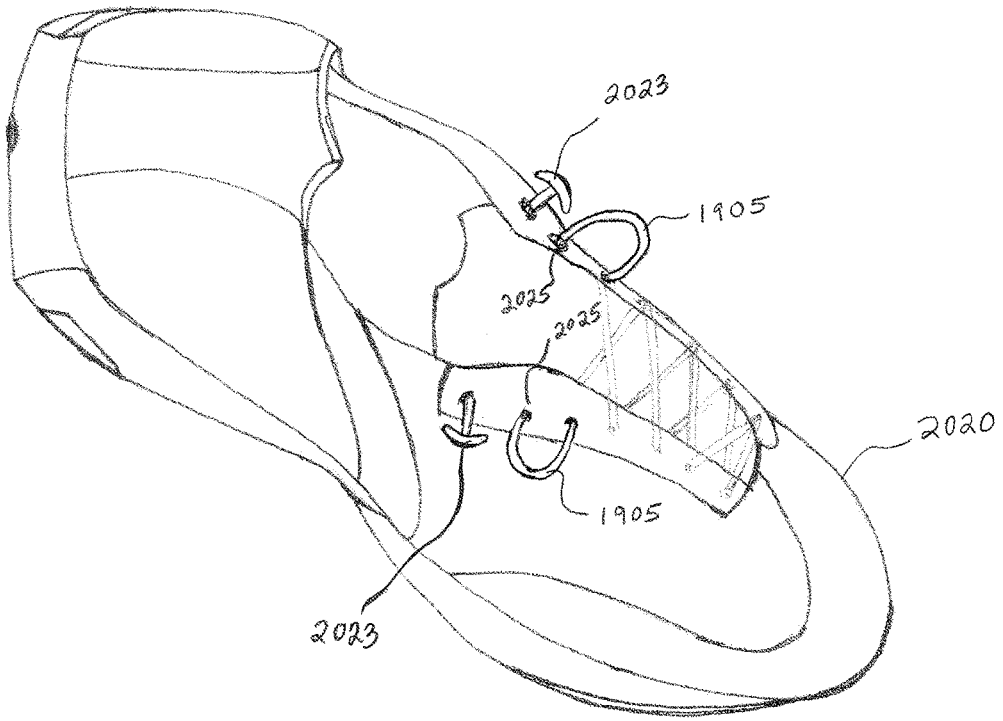
FIG. 19H is a perspective view of an exemplary fastener assembly according to another embodiment.
Figure 19I:
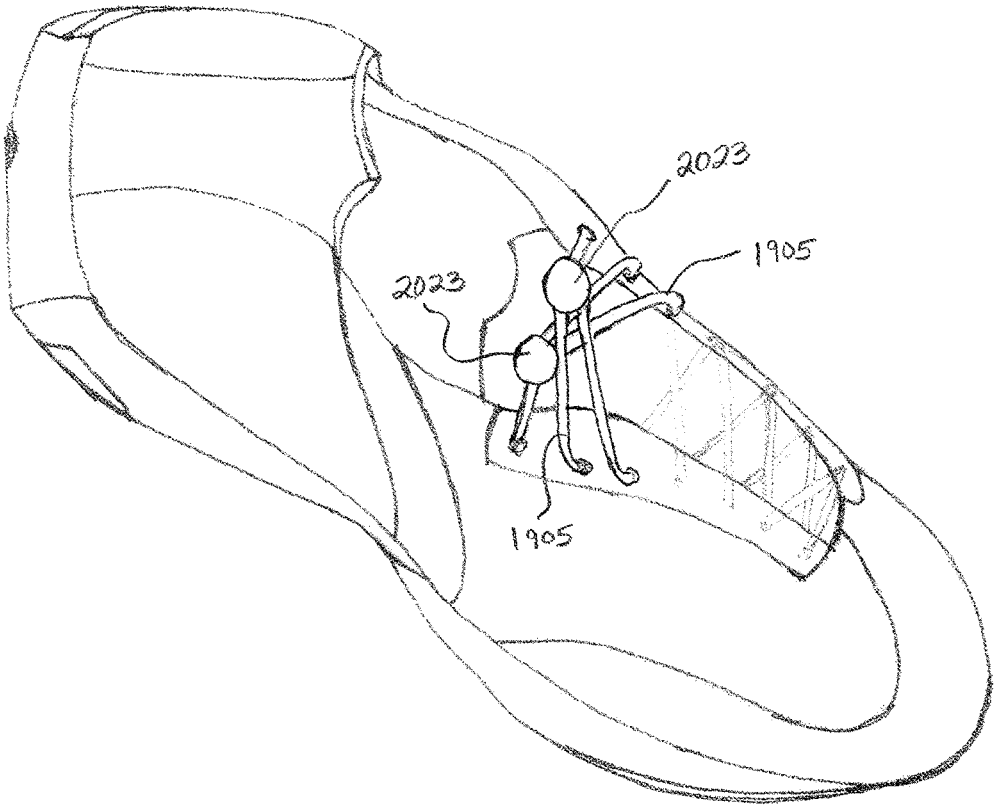
FIG. 19I is a perspective view of the fastener assembly of FIG. 19H in a fastened configuration.

FIG. 19H is a perspective view of an exemplary fastener assembly according to another embodiment, and FIG. 19I is a perspective view of the fastener assembly of FIG. 19H in a fastened configuration. In this alternate embodiment, two fastener bodies 2023 are provided each attached to end portions of a lace which is secured along an opening of an article 2020. In this embodiment, each fastener body 2023 is preferably oriented to face upwards at a pair of eyelets on the article 2020, with the lace being run beneath the article opening to an adjacent pair of eyelets 2025. Lace loops 1905 are formed by pulling up the slack in each end portion through the adjacent pair of eyelets 2025. Each lace loop is pulled diagonally over respective opposing fastener bodies 2101 to form the fastened configuration shown in FIG. 19I.

Figure 19J:
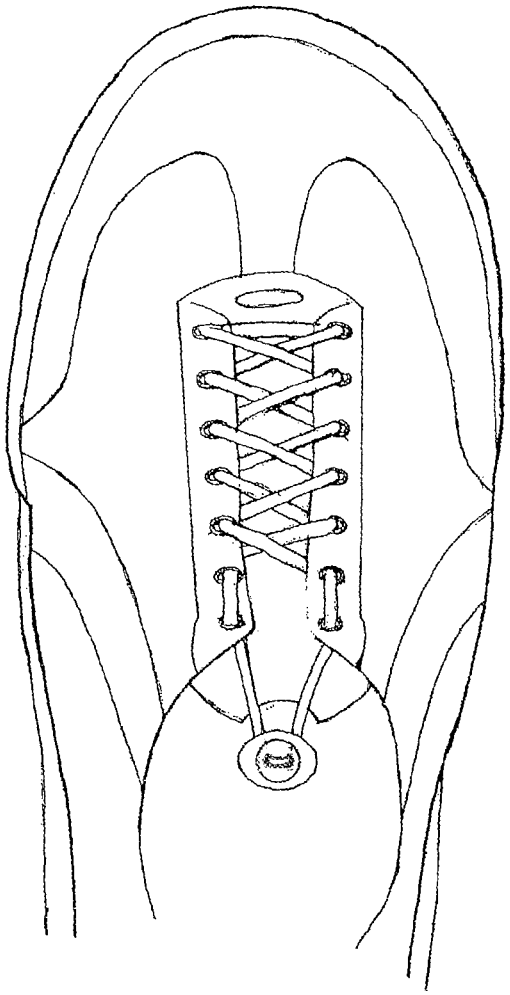
FIG. 19J is an exemplary illustration showing a shoelace being fastened using a fastener assembly according to an alternate embodiment, in which the lace is passed through the fastener assembly.

In yet another alternate embodiment as shown in FIG. 19J, an article may be provided having a lace secured thereon in a continuous loop, i.e., with no free end portions. Here as shown, the lace may be run through the fastener body, such that the fastener body is freely slidable along the lace.

Figure 19K:
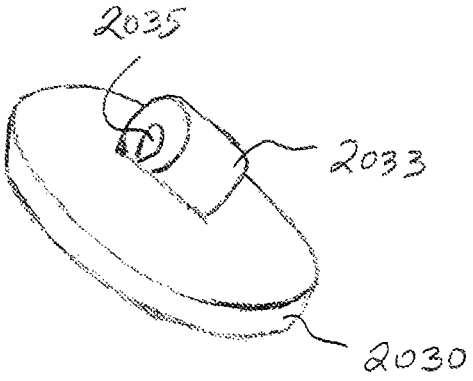
FIG. 19K is a perspective view of an alternate embodiment of a fastener body.

FIG. 19K depicts an alternate embodiment of a fastener body 2030, in which an external attachment point is provided. For example, a protrusion 2033 including an aperture 2035 may be provided on the fastener body 2030, as shown. The protrusion 2033 may be adapted to receive a lace therethrough to secure same to the fastener body 2030.

Although the embodiments which incorporate the teachings of the present invention have been shown and described in detail herein, those skilled in the art can readily devise many other varied embodiments that still incorporate these teachings. Having described preferred embodiments for a fastener assembly (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A fastener assembly comprising:

a fastener body having a substantially flat center portion and at least one aperture formed in said flat center portion, said at least one aperture comprising two apertures communicating with a cavity formed above the substantially flat center portion and having an open top, wherein the fastener body includes tapering downwards curved ends affixed on opposing ends of the substantially flat center portion, wherein said tapering downwards curved ends extend beneath the substantially flat center portion to form a concave bottom surface; and a cap configured to be removably inserted into the cavity.

2. The assembly of claim 1, wherein the tapering curved ends comprise solid ends.

3. The assembly of claim 1, wherein the tapering curved ends are configured to curve downwards in a direction away from the cap.

4. The assembly of claim 1, wherein the fastener body and the cap form a convex top surface.

5. The assembly of claim 4, wherein the convex top surface comprises a continuous convex surface from one opposing tapering curved end to the other.

6. The assembly of claim 1, further including a lace having a length sufficient to be secured at an article opening and to form at least one free end portion, wherein said at least one free end portion is inserted into the at least one aperture of the fastener body and secured thereon.

7. The assembly of claim 1, wherein the fastener body includes a rim formed at a top of the cavity.

8. The assembly of claim 7, wherein the cap comprises a laterally protruding bottom edge configured to mate with the rim of the fastener body.

9. A fastener assembly comprising:

a fastener body having a substantially flat center portion and at least one aperture formed in said flat center portion, said at least one aperture communicating with a cavity formed above the substantially flat center portion and having an open top, wherein the fastener body includes downwards curved ends affixed on opposing ends of the substantially flat center portion, wherein said downwards curved ends extend beneath the substantially flat center portion to form a concave bottom surface;

a cap configured to be removably inserted into the cavity; and a lace having a length sufficient to be secured at an article opening and to form at least one free end portion, wherein said at least one free end portion is inserted into the at least one aperture of the fastener body and secured thereon.

* * * * *